US007814998B2

(12) United States Patent
Patel et al.

(10) Patent No.: US 7,814,998 B2
(45) Date of Patent: Oct. 19, 2010

(54) SUPERABRASIVE CUTTING ELEMENTS WITH ENHANCED DURABILITY AND INCREASED WEAR LIFE, AND DRILLING APPARATUS SO EQUIPPED

(75) Inventors: Suresh G. Patel, The Woodlands, TX (US); Mathews George, Houston, TX (US); Richard J. McClellan, The Woodlands, TX (US); Paul E. Pastusek, Houston, TX (US); Innocent R. Rugashoborola, Houston, TX (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 46 days.

(21) Appl. No.: 11/958,082

(22) Filed: Dec. 17, 2007

(65) Prior Publication Data

US 2008/0164071 A1 Jul. 10, 2008

Related U.S. Application Data

(60) Provisional application No. 60/875,698, filed on Dec. 18, 2006.

(51) Int. Cl.
*E21B 10/46* (2006.01)

(52) U.S. Cl. ..... 175/432; 175/434

(58) Field of Classification Search ..... 175/428, 175/432, 434

See application file for complete search history.

(56) References Cited

U.S. PATENT DOCUMENTS

| | | | |
|---|---|---|---|
| 3,745,623 | A | 7/1973 | Wentorf, Jr. et al. |
| 4,200,159 | A | 4/1980 | Peschel et al. |
| RE32,036 | E | 11/1985 | Dennis |
| 4,592,433 | A | 6/1986 | Dennis |
| RE32,380 | E | 3/1987 | Wentorf, Jr. et al. |
| 5,016,718 | A | 5/1991 | Tandberg |
| 5,120,327 | A | 6/1992 | Dennis |

(Continued)

FOREIGN PATENT DOCUMENTS

| | | | |
|---|---|---|---|
| GB | 2367578 | A | 4/2002 |

(Continued)

OTHER PUBLICATIONS

PCT International Search Report for PCT/US2007/025762, mailed Mar. 20, 2008.

*Primary Examiner*—William P Neuder
(74) *Attorney, Agent, or Firm*—TraskBritt

(57) ABSTRACT

A cutting element for use in drilling subterranean formations. The cutting element includes a superabrasive table mounted to a supporting substrate. The superabrasive table includes a two-dimensional cutting face having a cutting edge along at least a portion of its periphery, and a surface comprising a chamfer extending forwardly and inwardly from proximate a peripheral cutting edge at a first acute angle of orientation of greater than about 45° with respect to the longitudinal axis of the cutting element, and to no greater than a selected depth. The chamfer may be arcuate or planar, and of a dimension sufficient to ensure that a wear flat generated during use of the cutting element remains outside the inner boundary of the chamfer within the chamfer envelope, and small enough to maintain aggressive cutting characteristics for the cutter. Drill bits and drilling tools bearing the cutting elements are also disclosed.

25 Claims, 7 Drawing Sheets

U.S. PATENT DOCUMENTS

| | | | | | |
|---|---|---|---|---|---|
| 5,435,403 | A | | 7/1995 | Tibbitts | |
| 5,437,343 | A | * | 8/1995 | Cooley et al. | 175/431 |
| 5,443,565 | A | | 8/1995 | Strange, Jr. | |
| 5,447,208 | A | | 9/1995 | Lund et al. | |
| 5,460,233 | A | | 10/1995 | Meany et al. | |
| 5,706,906 | A | | 1/1998 | Jurewicz et al. | |
| 5,881,830 | A | | 3/1999 | Cooley | |
| 5,960,896 | A | * | 10/1999 | Barr et al. | 175/431 |
| 5,979,579 | A | | 11/1999 | Jurewicz | |
| 6,298,930 | B1 | | 10/2001 | Sinor et al. | |
| 6,460,631 | B2 | | 10/2002 | Dykstra et al. | |
| 6,672,406 | B2 | * | 1/2004 | Beuershausen | 175/57 |
| 6,935,444 | B2 | | 8/2005 | Lund et al. | |
| 2004/0163854 | A1 | * | 8/2004 | Lund et al. | 175/431 |

FOREIGN PATENT DOCUMENTS

| | | | |
|---|---|---|---|
| GB | 2370300 | A | 6/2002 |
| GB | 2433524 | A | 6/2007 |

* cited by examiner

SUPERABRASIVE CUTTING ELEMENTS WITH ENHANCED DURABILITY AND INCREASED WEAR LIFE, AND DRILLING APPARATUS SO EQUIPPED

CROSS-REFERENCE TO RELATED APPLICATIONS

This application claims the benefit of U.S. Provisional Patent Application Ser. No. 60/875,698, filed Dec. 18, 2006, the disclosure of which is hereby incorporated herein in its entirety by this reference.

TECHNICAL FIELD

Embodiments of the invention relate to cutting elements and apparatus so equipped for use in drilling subterranean formations. More particularly, embodiments of the invention relate to a polycrystalline diamond or other superabrasive cutting element, or cutter, configured for use on a rotary drag bit or other tool used for earth or rock boring, such as may occur in the drilling or enlarging of an oil, gas, geothermal or other subterranean borehole, and to bits and tools so equipped.

BACKGROUND

There are three types of bits which are generally used to drill through subterranean formations, including percussion bits (also called impact bits), rolling cone bits, including tri-cone bits, and rotary drag bits or fixed cutter rotary bits (including core bits so configured). Rotary drag bits conventionally employ diamond or other superabrasive cutting elements or "cutters," with the use of polycrystalline diamond compact (PDC) cutters being most prevalent.

In addition to conventional, concentric rotary drag and bits, there are other apparatus employed downhole and generically termed "tools" herein, which may be employed to cut or enlarge a borehole or which may employ superabrasive cutters, inserts or plugs on the surface thereof as cutters or wear-prevention elements. Such tools include, without limitation, bicenter bits, eccentric bits, expandable reamers, and reamer wings.

It has been known in the art for many years that PDC cutters perform well on drag bits and other rotary tools. A PDC cutter typically has a diamond layer or table formed under high temperature and pressure conditions to a cemented carbide substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing element) directly into a preformed pocket, socket or other receptacle on the face of a bit body, as on a matrix-type bit formed of WC particles cast in a solidified, usually copper-based, binder as known in the art.

A PDC is normally fabricated by placing a disk-shaped, cemented carbide substrate into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to form the polycrystalline diamond structure As a result, the diamond grains become mutually bonded to form a diamond table over the substrate face, which diamond table is also bonded to the substrate face. The metal binder may remain in the diamond layer within the pores existing between the diamond grains or all or a portion of the metal binder may be removed, as well known in the art. The binder may be removed by acid leaching or an electrolytic leaching process. For more background information concerning processes used to form polycrystalline diamond cutters, the reader is directed to U.S. Pat. No. 3,745,623, issued on Jul. 17, 1973, in the name of Wentorf, Jr. et al., the disclosure of which patent is incorporated by reference herein.

An embodiment of a conventional rotary drag bit is shown in FIG. 1. The drag bit of FIG. 1 is designed to be turned in a clockwise direction (looking downward at a bit being used in a hole, or counterclockwise if looking at the bit from its leading end, or face as shown in FIG. 1) about its longitudinal axis. The majority of current drag bit designs employ diamond cutters comprising PDC diamond tables formed on a substrate, typically of cemented tungsten carbide (WC) State-of-the-art drag bits may achieve a rate of penetration (ROP) under appropriate weight on bit (WOB) and applied torque, ranging from about one to in excess of one thousand feet per hour. A disadvantage of state-of-the-art PDC drag bits is that they may prematurely wear due to impact failure of the PDC cutters, as such cutters may be damaged very quickly if used in highly stressed or tougher formations composed of limestones, dolomites, anhydrites, cemented sandstones, interbedded formations, also known as transition zones, such as shale with sequences of sandstone, limestone and dolomites, or formations containing hard "stringers." As noted above, there are additional categories of tools employed in boreholes, which tools employ superabrasive cutting elements for cutting, and which suffer the same deficiencies in the drilling the enumerated formations. In many such formations, other types of cutting structures have been employed in drag bits, including small natural diamonds, small so-called "thermally stable" PDC cutters, and diamond grit-impregnated metal carbide matrix-type cutting structures of various configurations. However, such drag bits provide a much-inferior ROP to PDC cutter-equipped bits and so incur substantial additional drilling cost in terms of rig and drilling crew time on site.

Conventional PDC cutters experience durability problems in high load applications. They have an undesirable tendency to crack (including microcracking), chip, spall, and break when exposed to hard, tough or highly stressed geologic structures so that the cutters consequently sustain high loads and impact forces. They are similarly weak when placed under high loads from a variety of angles. The durability problems of conventional PDCs are worsened by the dynamic nature of both normal and torsional loading during the drilling process, wherein the bit face moves into and out of contact with the uncut formation material forming the bottom of the wellbore, the loading being further aggravated in some bit designs and in some formations by so-called bit "whirl."

The diamond table/substrate interface of conventional PDCs is subject to high residual stresses arising from formation of the cutting element, as during cooling, the differing coefficients of thermal expansion of the diamond and substrate material result in thermally induced stresses. In addition, finite element analysis (FEA) has demonstrated that high tensile stresses exist in a localized region in the outer cylindrical substrate surface and internally in the substrate. Both of these phenomena are deleterious to the life of the cutting element during drilling operations as the stresses, when augmented by stresses attributable to the loading of the cutting element by the formation, may cause spalling, fracture or even delamination of the diamond table from the substrate.

Further, high tangential loading of the cutting edge of the cutting element results in bending stresses on the diamond table, which is relatively weak in tension and will thus fracture easily if not adequately supported against bending. The metal carbide substrate on which the diamond table is formed may be of inadequate stiffness to provide a desirable degree of such support.

The relatively rapid wear of diamond tables of conventional PDC cutters also results in rapid formation of a wear flat in the metal carbide substrate backing the cutting edge, the wear flat reducing the per-unit area loading in the vicinity of the cutting edge and requiring greater weight on bit (WOB) to maintain a given rate of penetration (ROP). The wear flat, due to the introduction of the substrate material as a contact surface with the formation, also increases drag or frictional contact between the cutter and the formation due to modification of the coefficient of friction. As one result, frictional heat generation is increased, elevating temperatures in the cutter and initiating damage to the PDC table in the form of heat checking while, at the same time, the presence of the wear flat reduces the opportunity for access by drilling fluid to the immediate rear of the cutting edge of the diamond table.

There have been many attempts in the art to enhance the durability of conventional PDC cutters by modification of cutting face geometry, specifically in the vicinity of the cutting edge which engages the formation being drilled. By way of example, the reader is directed to U.S. Pat. RE32,036 to Dennis (the '036 patent); U.S. Pat. No. 4,592,433 to Dennis (the '433 patent); and U.S. Pat. No. 5,120,327 to Dennis (the '327 patent). In FIG. 5A of the '036 patent, a cutter with a beveled peripheral edge is depicted, and briefly discussed at Col. 3, lines 51-54. In FIG. 4 of the '433 patent, a very minor beveling of the peripheral edge of the cutter substrate or blank having grooves of diamond therein is shown (see Col. 5, lines 1-2 of the patent for a brief discussion of the bevel). Similarly, in FIGS. 1-6 of the '327 patent, a minor peripheral bevel is shown (see Col. 5, lines 40-42 for a brief discussion of the bevel). Such bevels or chamfers were originally designed to protect the cutting edge of the PDC while a stud carrying the cutting element was pressed into a pocket in the bit face. However, it was subsequently recognized that the bevel or chamfer protected the cutting edge from load-induced stress concentrations by providing a small load-bearing area which lowers unit stress during the initial stages of drilling. The cutter loading may otherwise cause chipping or spalling of the diamond layer at an unchamfered cutting edge shortly after a cutter is put into service and before the cutter naturally abrades to a flat surface, or "wear flat," at the cutting edge.

It is also known in the art to radius, rather than chamfer, a cutting edge of a PDC cutter, as disclosed in U.S. Pat. No. 5,016,718 to Tandberg. Such radiusing has been demonstrated to provide a load-bearing area similar to that of a small peripheral chamfer on the cutting face.

For other approaches to enhance cutter wear and durability characteristics, the reader is also referred to U.S. Pat. No. 5,437,343 to Cooley et al. (the '343 patent); and U.S. Pat. No. 5,460,233 to Meany et al. (the '233 patent), assigned to the assignee of the present invention. In FIGS. 3 and 5 of the '343 patent, it can be seen that multiple, adjacent chamfers are formed at the periphery of the diamond layer (see Col. 4, lines 31-68 and Cols. 5-6 in their entirety). In FIG. 2 of the '233 patent, it can be seen that the tungsten carbide substrate backing the superabrasive table is tapered at about 10-15° to its longitudinal axis to provide some additional support against catastrophic failure of the diamond layer (see Col. 5, lines 2-67 and Col. 6, lines 1-21 of the '233 patent). The disclosures of each of the '343 patent and the '233 patent are incorporated by reference herein. See also U.S. Pat. No. 5,443,565 to Strange for another disclosure of a multi-chamfered diamond table.

It is known that conventionally providing larger chamfers on cutters enhances durability, but at the same time reduces ROP and undesirably increases required WOB for a given ROP. The increased WOB translates to more energy applied to the drilling system, and specifically the drag bit which, in turn, stimulates cutter damage.

U.S. Pat. No. 5,706,906 to Jurewicz et al., assigned to the assignee of the present invention and the disclosure of which is incorporated by reference herein, describes PDC cutters of substantial depth or thickness, on the order of about 0.070 inch to 0.150 inch and having cutting faces with extremely large chamfers or so-called "rake lands" on the order of not less than about 0.050 inch, as measured radially along the surface of the rake land.

A PDC cutter as described in the '906 patent has demonstrated, for a given depth of cut and formation material being cut, a substantially enhanced useful life in comparison to prior art PDC cutters due to a greatly reduced tendency to catastrophically spall, chip, crack, and break. It has been found that the cutter in PDC form may tend to show some cracks after use, but the small cracks do not develop into a catastrophic failure of the diamond table as typically occurs in PDC cutters. This capability, if fully realized, would be particularly useful in a cutter installed on a drag bit to be used on hard rock formations and softer formations with hard rock stringers therein (mixed interbedded formations).

While such PDC cutters, with their large rake lands, have shown some promise in initial field testing, conclusively proving the durability of the design when compared to other cutters of similar diamond table thickness but without the large rake land, these PDC cutters also demonstrated some disadvantageous characteristics which impaired their usefulness in real-world drilling situations. Specifically, drill bits equipped with these PDC cutters demonstrated a disconcerting tendency, apparently due to the extraordinarily great cutting forces generated by contact of these cutters with a formation being drilled, to overload drilling motors, other bottomhole assembly (BHA) components such as subs and housings, as well as tubular components of the drill string above the BHA.

Further, bits equipped with these PDC cutters often drilled significantly slower, that is to say, their rate of penetration (ROP) of the formation was far less than, the ROP of bits equipped with conventional PDC cutters, and also exhibited difficulty in drilling through hard formations for which they would be otherwise ideally suited. It appears that the exterior configuration of these thick diamond table cutters, although contributing to the robust nature of the cutters, may be less than ideal for many drilling situations due to the variable geometry of the arcuate rake land as it contacts the formation and attendant lack of "aggressiveness" in contacting and cutting the formation. It is conceivable, as demonstrated in the cutting of metal with similarly shaped structures, that in plastic formations these PDC cutter may simply deform the material of the formation face engaged by the cutter, forming a plastic "prow" of rock ahead and flanking the cutter, instead of shearing the formation material as intended.

Therefore, despite the favorable characteristics exhibited by these PDC cutters, their utility in efficiently cutting the difficult formations for which its demonstrated durability is ideally suited remains, as a practical matter, unrealized over a broad range of formations and drilling conditions.

U.S. Pat. No. 5,881,830 to Cooley, assigned to the assignee of the present invention and the disclosure of which is incorporated by reference herein, describes PDC cutters having cutting faces with a first portion transverse to a longitudinal axis of the cutter and a second portion comprising a planar engagement surface or buttress plane oriented at a small, acute angle to the first portion and having a cutting edge along at least a portion of its periphery. These PDC cutters are described as durable, fairly aggressive and providing a more consistent performance over the life of the cutter than the PDC cutters described in the '906 patent, but their large chamfers result in an unacceptable reduction in aggressivity in cutting, leading to a reduced ROP.

In addition, U.S. Pat. No. 6,935,444 to Lund et al., assigned to the assignee of the present invention and the disclosure of which is incorporated by reference herein, discloses the use of multiple, adjacent chamfers having an arcuate surface located therebetween along a cutting edge of a PDC cutter. Such a geometry has been demonstrated to inhibit initial chipping of a PDC cutter along the cutting edge, prolonging the life thereof.

However, and as noted with regard to the PDC cutter designs discussed above, there remains a need for a robust superabrasive cutter which will withstand cutting stresses in the difficult formations referenced above and exhibit reduced wear tendencies while drilling effectively with, and without damage to, conventional, state-of-the-art bottomhole assemblies and drill strings, while providing commercially viable, consistent ROP.

During laboratory testing, it has been observed that conventional, 45° chamfer angle cutters with conventional chamfer depths on the order of, for example, 0.016 inch, commonly experience premature cutter damage and failure when the wear flat extends inwardly of the inner boundary of the chamfer. Specifically, an increased incidence of spalling and chipping of the PDC table has been observed. This is a particular problem in the aforementioned highly stressed or tougher formations, interbedded formations and formations containing hard stringers.

Several factors are believed to contribute to these types of cutter failure. First, during a drilling operation, downward force is applied to the competent formation under WOB as a result of chamfer and cutter backrake angle, maintaining the PDC table in compression and adding to cutter integrity. However, when the inner edge or boundary of the chamfer is worn away, the chamfer component of the compressive forces is diminished, with a consequent potential for high tensile shear forces to be present at the cutting face, resulting in the aforementioned spalling and chipping. Further, when the inner edge or boundary of the chamfer is worn away, a sharp edge or corner at the cutting face is presented to the formation, similar to that presented by an unchamfered cutter. Any vertical (parallel to the plane of the cutting face) forces acting on this sharp edge will translate as vertical tensile shear across the cutting face, resulting in a spatted cutter.

In addition, heat checking in the PDC table, due to the initiation of a large, relatively wide wear flat is particularly significant toward the rear of the wear flat and may result in significant breakage of the PDC table at the back and sides thereof.

BRIEF SUMMARY OF THE INVENTION

In one embodiment, a cutter according to the invention comprises a superabrasive table mounted to a supporting substrate of a metal material such as a cemented metal carbide. The cutter has a longitudinal axis extending generally transversely to the plane of the cutting face. In a cylindrical cutter configuration, the longitudinal axis would be coincident with the centerline of the cutter. A chamfer is provided adjacent at least a portion of a periphery of the superabrasive table, the chamfer lying at a relatively steep chamfer angle of greater than about 45° to the longitudinal axis of the cutter, or with respect to the line of the sidewall of the cutter (assuming the cutter has a sidewall parallel to the longitudinal axis of the cutter). The chamfer may be arcuate, or planar. The chamfer depth, in conjunction with the relatively steep chamfer angle, is sufficient to maintain a wear flat outside the inner boundary of the chamfer on the cutting face, yet small enough to avoid substantially compromising aggressivity of the cutter.

By employing a relatively steep chamfer angle, aggressivity of the cutter is maintained, as force applied to the formation under the cutter is more concentrated, compressing less of the formation and resulting in less sliding friction between the cutter and the formation, maintaining a sharp cutting edge. Required WOB may be reduced with the use of relatively steep chamfer angles, as they penetrate the formation to a desired depth of cut more efficiently, reduce friction and consequent heat, and prolong cutter life.

With relatively steep chamfer angles, a smaller, smaller in length wear flat is generated in comparison to wear flats generated on conventionally chamfer angled cutters, reducing heat checking resulting from thermal stress on the PDC table.

By containing the wear flat outside the inner boundary of the chamfer and within the chamfer envelope, forces on the cutter substantially parallel to the cutting face are distributed over the chamfer surface, reducing the incidence of cutter spalling. This may be due to the ability of such a cutter to withstand significantly greater magnitude of drilling vibrations. The term "chamfer envelope," as used herein with respect to wear flat development on the cutting face of the superabrasive table, means the portion of the cutting face outside the inner boundary of the chamfer. Stated another way, and in the context of use of the cutter for drilling a subterranean formation, the term means an area on the cutting face between the portion of the cutting edge in contact with a formation during drilling and the adjacent inner boundary of the chamfer.

It has also been noted by the inventors that cutters configured with steep chamfer angles according to some embodiments of the invention may be particularly suited to placement on relatively low load areas of a bit where enhanced cutting efficiency is required, such as on the nose, shoulder, and gage regions of the bit. Other embodiments of cutters of the invention may be particularly suited to placement on high load areas of the bit, such as on a region of the bit proximate the longitudinal axis, generally termed the cone region, where there are relatively high forces on the cutters due to low cutter redundancy at a given radius on the bit face, and cutters have a greater area of cut.

Accordingly, cutters according to various embodiments of the invention may be placed on the face of a bit in consideration of the work demanded of a cutter at a given location and chamfer angle and size.

Rotary drag bits and other fixed cutter drilling tools incorporating embodiments of cutters of the invention are also encompassed thereby.

BRIEF DESCRIPTION OF THE SEVERAL VIEWS OF THE DRAWINGS

The foregoing and other features and advantages of the invention will become apparent to persons of ordinary skill in the art upon reading the specification in conjunction with the accompanying drawings, wherein.

DETAILED DESCRIPTION OF THE INVENTION

Figure 1:
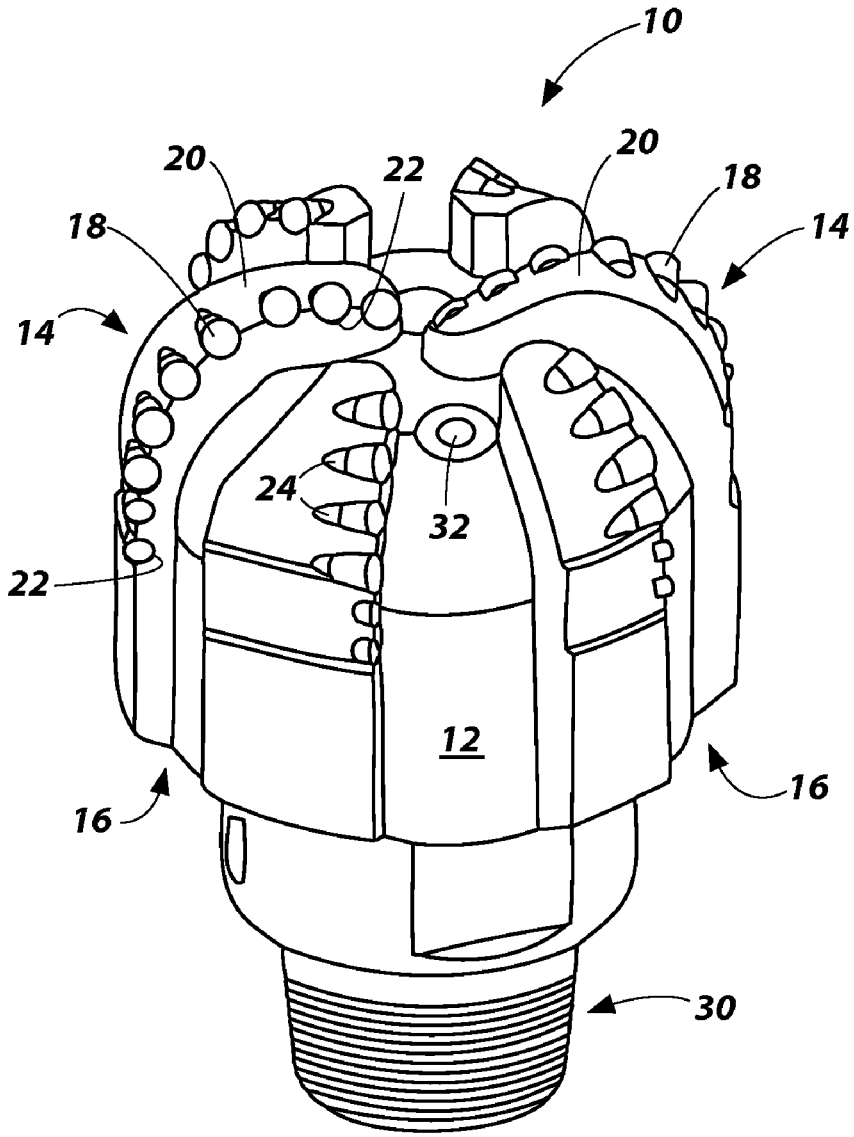
FIG. 1 is a perspective view of a conventional drag bit.

Referring to FIG. 1, a conventional fixed-cutter rotary drill bit 10 includes a bit body 12 that has generally radially projecting and longitudinally extending wings or blades 14, which are separated by junk slots 16. A plurality of PDC cutters 18 are provided on the leading faces of the blades 14 extending over the face 20 of the bit body 12. The face 20 of the bit body 12 includes the surfaces of the blades 14 that are configured to engage the formation being drilled, as well as the exterior surfaces of the bit body 12 within the channels and junk slots 16. The plurality of PDC cutters 18 may be provided along each of the blades 14 within pockets 22 formed in the blades 14, and may be supported from behind by buttresses 24, which may be integrally formed with the bit body 12.

The drill bit 10 may further include an API threaded connection portion 30 for attaching the drill bit 10 to a drill string (not shown). Furthermore, a longitudinal bore (not shown) extends longitudinally through at least a portion of the bit body 12, and internal fluid passageways (not shown) provide fluid communication between the longitudinal bore and nozzles 32 provided at the face 20 of the bit body 12 and opening onto the channels leading to junk slots 16.

During drilling operations, the drill bit 10 is positioned at the bottom of a well borehole and rotated while weight on bit is applied and drilling fluid is pumped through the longitudinal bore, the internal fluid passageways, and the nozzles 32 to the face 20 of the bit body 12. As the drill bit 10 is rotated, the PDC cutters 18 scrape across and shear away the underlying earth formation. The formation cutting mix with and are suspended within the drilling fluid and pass through the junk slots 16 and up through an annular space between the wall of the borehole and the outer surface of the drill string to the surface of the earth formation.

The inventors contemplate that embodiments of the cutter of the invention will be used primarily on rotary drag bits as described above and including without limitation core bits, bi-center bits, and eccentric bits, as well as on fixed cutter drilling tools of any configuration, including without limitation reamers or other hole opening tools. As used herein, the term "bit" includes all such bits and tools.

Figure 2A:
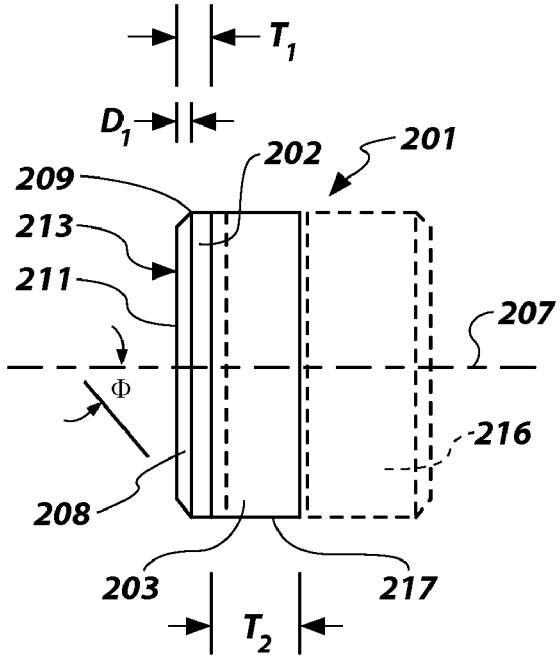
FIGS. 2*a* through 2*d* depict, respectively, a side view, an enlarged side view, a front view, and a perspective view, of an embodiment of a superabrasive cutter of the present invention.
Figure 2B:
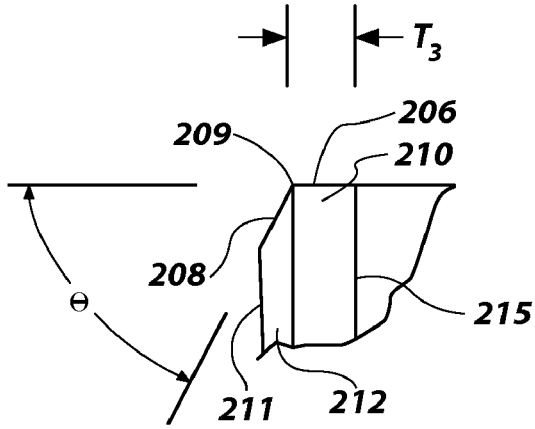
Figure 2C:
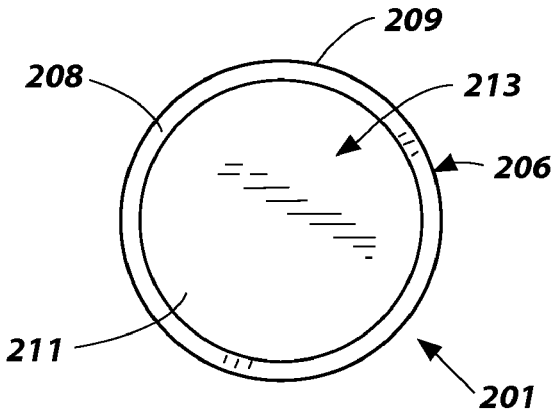
Figure 2D:
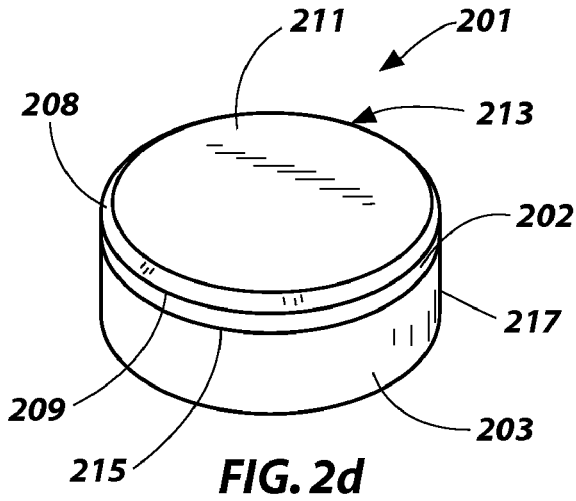

It is also contemplated by the inventors that embodiments of the cutter of the invention may be used at various locations on a bit or other drilling tool, such as on cone, nose, shoulder and gage regions of a bit or tool face, and may be positioned as primary cutters along a rotationally leading edge of a blade of a bit, or as so-called "back up" cutters rotationally trailing one or more primary cutters on a blade. Such back up cutters may be positioned to exhibit an exposure the same as, greater than, or less than, an associated primary cutter. Reference is made to FIGS. 2*a* through 2*d* which depict a side view, an enlarged side view, an end view, and a perspective view, respectively, of one embodiment of the cutter of the present invention. The cutter 201 is of a shallow frustoconical configuration and includes a circular diamond layer or table 202 (e.g., a polycrystalline diamond compact) bonded (i.e., sintered) to a cylindrical substrate 203 (e.g., tungsten carbide). The interface between the diamond layer and the substrate is, as shown, comprised of a diametrically extending recess within the substrate 203 into which a portion of the diamond table 202 projects (shown in broken lines in FIG. 2*a*), defining a so-called "bar" of diamond in accordance with U.S. Pat. No. 5,435,403, assigned to the assignee of the present invention. Of course, many other interface geometries are known in the art and suitable for use with the invention. The diamond layer 202 is of a thickness "$T_1$" as shown in FIG. 2*a*. The substrate 203 has a thickness "$T_2$," also as shown in FIG. 2*a*. The diamond layer 202 includes an arcuate chamfer 208 with a chamfer angle Θ relative to the sidewall 206 of the diamond layer 202 (parallel to the longitudinal axis or center line 207 of the cutter 201) and extending forwardly and radially inwardly toward the longitudinal axis 207. The chamfer angle Θ in the illustrated embodiment is defined as the included acute angle between the surface of chamfer 208 and the sidewall 206 of the diamond layer 202 that, in the illustrated embodiment, is parallel to longitudinal axis 207. The chamfer angle Θ may be in the range of greater than about 45° to about 85°. It is currently believed that a particularly suitable range of chamfer angles Θ is about 50° to about 75°.

The dimensions of the chamfer 208 are significant to performance of the cutter. The inventors have found that the depth "$D_1$" of the chamfer 208 should be at least about 0.002 inch and no more than about 0.025 inch, measured from a line transverse to the longitudinal axis of the cutter at the inner boundary of the chamfer to the outer periphery of the cutting edge in a direction along or parallel to the longitudinal axis, or the sidewall of the cutter if the cutter is substantially cylindrical. It is significant that the wear flat of the cutter be maintained within the chamfer or, stated another way, to maintain the wear flat of the cutter outside of the inner boundary of the chamfer on the cutting face.

Diamond table 202 also includes a cutting face 213 having a flat central area 211 radially inward of chamfer 208, and a cutting edge 209. Between the cutting edge 209 and the substrate 203 resides a portion or depth of the diamond layer 202 referred to as the base layer 210 having a thickness $T_3$ (FIG. 2*c*), while the portion or depth $D_1$ (FIG. 2*a*) between the flat central area 211 of cutting face 213 and the base layer 210 having the thickness $T_1$ is referred to as the chamfer layer 212. The term "layer" is one of convenience only for physical description, as the various "layers" of the diamond table 202 are, in fact, formed as one integral mass, as known in the art. However, it is known to layer the diamond table 202 with different sized diamond grit for different characteristics, although such grit layers may not necessarily correspond to the layers of the diamond table 202 as described herein.

The central area 211 of cutting face 213, as depicted in FIGS. 2*a*, 2*b*, 2*c*, and 2*d*, is a substantially flat surface oriented perpendicular to longitudinal axis 207.

In the depicted cutter, the thickness $T_1$ of the diamond layer 202 may lie in the range of about 0.030 inch to about 0.120 inch, with a particularly suitable thickness range currently believed to be from about 0.060 inch to about 0.080 inch. Such a diamond layer thickness results in a cutter that, in combination with the aforementioned chamfer size and angle ranges, exhibits substantially improved impact resistance, abrasion resistance and erosion resistance. Further, the foregoing thickness ranges are nominal ranges, without taking into consideration protrusions of the diamond layer 202 into the substrate 203 or vice-versa, such as occur when a non-planar diamond layer/substrate interface topography is employed, as is well known in the art. In any case, beyond a minimum diamond layer thickness sufficient to provide the aforementioned advantages, the diamond layer thickness employed is not significant to the invention.

The boundary 215 of the diamond layer 202 and substrate to the rear of the cutting edge 209 is desirably at least about 0.005 inch longitudinally to the rear of the cutting edge. The inventors believe that the aforementioned minimum cutting edge to interface distance is desirable to ensure that the area of highest residual stress (i.e., the area to the rear of the location where the cutting edge of the cutter contacts the formation being cut) is not subject to early point loading, and to ensure that an adequate, rigid mass of diamond and substrate material supports the line of high loading stress.

As shown in FIGS. 2*a*-2*d*, the sidewall 217 of the cutter 201 is parallel to the longitudinal axis 207 of the cutter 201. Thus, as shown, chamfer angle Θ equals angle Φ, the angle between chamfer 208 and axis 207 (FIG. 2*a*). However, cutters of the present invention need not be circular or even symmetrical in cross-section, and the cutter sidewall, or a portion extending to the rear of the chamfer in the superabrasive table and sidewall of the supporting substrate may not always parallel the longitudinal axis of the cutter. Thus, the chamfer angle may be set as angle Θ or as angle Φ, depending upon cutter configuration and designer preference. A significant aspect of the invention regarding angular orientation of the chamfer is the presentation of the chamfer to the formation at an angle effective to achieve the advantages of the invention in terms of maintaining an aggressive cutting structure while preserving cutter integrity.

Another optional but desirable feature of the embodiment of the invention depicted in FIGS. 2*a* through 2*d* is the use of a low friction finish on the cutting face 213, including chamfer 208. A suitable low friction finish is a polished mirror finish which has been found to reduce friction between the diamond table 202 and the formation material being cut and to enhance the integrity of the cutting face surface. For further detail on the aforementioned finish, the reader is directed to U.S. Pat. No. 5,447,208 issued to Lund et al., assigned to the assignee of the present invention and the disclosure of which is incorporated herein in its entirety by reference, for additional discussion and disclosure of polished superabrasive cutting faces.

Another optional cutter feature usable in the invention, and depicted in broken lines in FIG. 2*a*, is the use of a backing cylinder 216 face-bonded to the back of substrate 203. This design permits the construction of a cutter having a greater dimension (or length) along its longitudinal axis 207 to provide additional area for bonding (as by brazing) the cutter to the bit face, and thus to enable the cutter to withstand greater forces in use without breaking free of the bit face. Such an arrangement is well known in the art and disclosed in U.S. Pat. No. 4,200,159. However, the presence or absence of such a backing cylinder does not affect the durability or wear characteristics of the inventive cutter.

Figure 3:
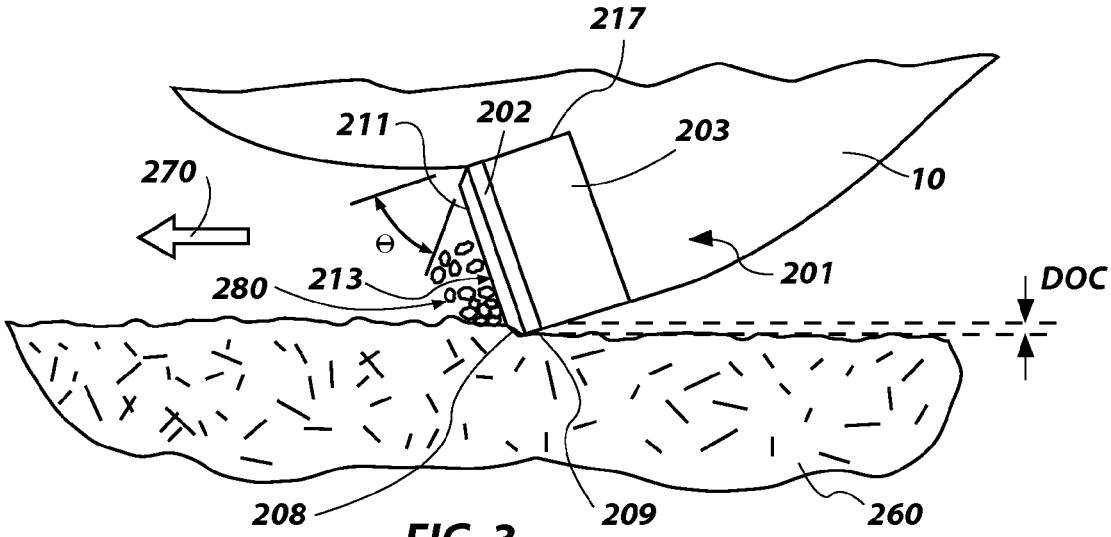
FIG. 3 depicts the embodiment of FIGS. 2*a* through 2*d* of the superabrasive cutter of the present invention in use engaging a subterranean formation.

FIG. 3 depicts an embodiment of the cutter 201 of the invention in use on a bit 10. The cutter 201 has a diamond table 202 sintered onto a tungsten carbide substrate 203. The diamond table 202 has a chamfer 208 which has a chamfer angle Θ with respect to sidewall 217. The cutter 201 has a cutting face 213 with a central flat area 211. Cutting face 213 cuts the rock 260, contacting it at cutting edge 209. As the bit 10, with cutter 201, moves in the direction indicated by arrow 270, the cutter 201 cuts into rock 260, resulting in rock particles or chips 280 sliding across the cutting face 213. The cutting action of the cutter 201 results in a cut being made in the rock 260, the cut having depth of cut (DOC). The cutting action that takes place when the invented cutter is used is a shearing action, such as occurs with unchamfered cutters or cutters with smaller depth chamfers, due to the relatively high chamfer angle, which provides an aggressive cutter which is also robust.

It is contemplated that different chamfer angles Θ may be selected in order to increase either cutting face strength or depth of cut. As Θ is increased, cutting edge loading per unit area increases and depth of cut should increase, resulting in a corresponding increase in the rate of penetration through the formation for a given WOB. Conversely, as Θ is decreased, cutting edge loading per unit area decreases, depth of cut decreases, and rate of penetration decreases for a given WOB.

Figure 4:
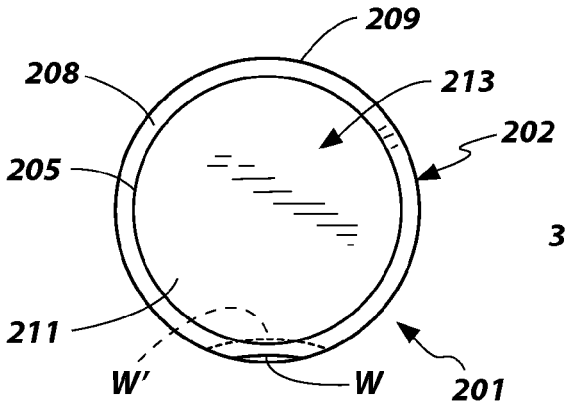
FIG. 4 depicts a partially worn cutter according to the embodiment of FIGS. 2*a* through 2*d* of the present invention.

In FIG. 4, an end view of the embodiment of cutter 201 from its diamond table 202 or cutting face 213 is provided. The cutting edge 209, chamfer 208, inner boundary 205 of the chamfer 208, and central cutting face area 211 are all depicted. As the cutter 201 is used, it will develop a shorter, relatively narrow and shallow wear flat W, that is only slightly broader adjacent the cutting edge 209 or periphery of the cutter 201 (i.e., adjacent the cutter sidewall) than it is at the inner portion of the chamfer 208 adjacent but outside inner boundary 205, in comparison to conventionally chamfered cutters with a 45° chamfer angle, wherein the wear flat is significantly longer and deeper, extending inside of inner boundary 205 as shown in broken lines W' on FIG. 4 and extending farther to the rear of the cutting edge into the sidewall 206 of the diamond table 202 as well as to a greater width (not shown). The cutter 201 of the invention may be embodied in a half cutter (180° cutting face), a third cutter (120° cutting face), a quarter cutter (90° cutting face) or any other portion of a full cylindrical cutter. Alternatively, a cutter which embodies the inventive concept that is not cylindrical in shape may be formed. It is contemplated that a cutter with a steeply angled chamfer in accordance with embodiments of the invention may be constructed with various cutting face shapes including without limitation a square, rectangular, triangular, pentagonal, hexagonal, heptagonal, octagonal, otherwise shaped as an n-sided polygon (where n is an integer), oval, elliptical, or other shape, in a cross section taken orthogonal to the longitudinal axis of the cutter.

Embodiments of the cutter of the invention improve cutter performance by providing a cutter which has been found to cut a subterranean formation at a rate of penetration (ROP) equivalent to that of a typical conventional cutter of similar diameter and composition, with a similar-sized chamfer, but at a conventional, 45° chamfer angle, in combination with the ability to cut a substantially greater volume of formation material before wearing to a point where effective cutting action ceases. Embodiments of the cutter of the invention have also been found, in laboratory testing, to exhibit greater wear resistance as well as resistance to spalling, chipping, heat checking, and microcracking of the PDC table than prior art cutters having a similar chamfer depth but conventional 45° chamfer angles.

The superabrasive table may be made from polycrystalline diamond or thermally stable polycrystalline diamond, depending upon the application. Further, a polycrystalline diamond table may have catalyst or binder removed only to a selected depth below the cutting face and along the sidewall of the table, as is known in the art. In lieu of a polycrystalline diamond table, a table or compact structure of any of the following types may be used in the cutter: diamond film (including CVD), cubic boron nitride, and a structure predicted in the literature as $C_3N_4$ being equivalent to known superabrasive materials. Cutters according to embodiments of the invention may be manufactured using the conventional processes as briefly mentioned in the Background hereof, such processes being well known to those of ordinary skill in the art. Of course, if materials other than diamond particles are used for the cutter table, or if materials other than a cemented carbide, such as tungsten carbide (WC), are used for the substrate, then the manufacturing process may be modified appropriately. The inventors contemplate that numerous substrates other than tungsten carbide may be used to make the invented cutter. Appropriate substrate materials include any cemented metal carbide such as carbides of tungsten (W), niobium (Nb), zirconium (Zr), vanadium (V), tantalum (Ta), titanium (Ti), and hafnium (Hf).

Figure 5:
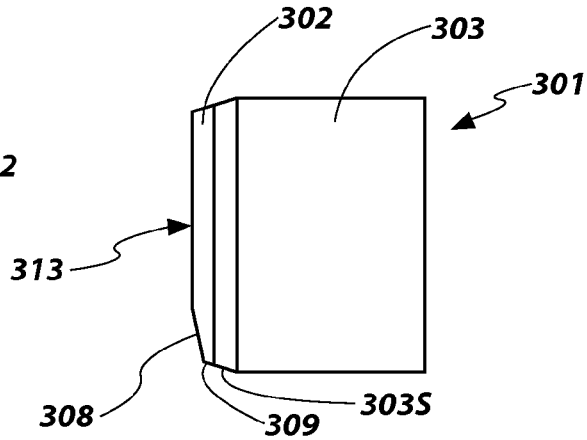
FIG. 5 depicts a side view of another embodiment of the cutter of the present invention.
Figure 5A:
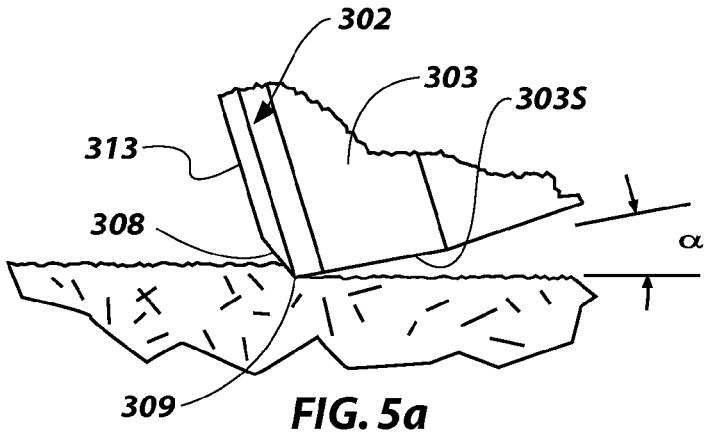
FIG. 5*a* depicts an enlarged side view of a portion of a cutter of FIG. 5 engaging a subterranean formation.

A further embodiment of a cutter 301 according to the present invention and exhibiting a substantially planar chamfer 308 on a superabrasive table 302 across a portion of cutting face 313 and extending to a cutting edge 309 is depicted in FIG. 5. Such a substantially planar chamfer 308 may be formed simultaneously with the superabrasive table 302, or machined thereafter. Alternatively, a portion of the superabrasive table 302 of such a cutter, or of circular cutters, may be laser-stitched to produce a weakened corner which will break away from the superabrasive table 302 edge preferentially, resulting in the desired chamfer profile and cutting edge 309 in terms of depth and angle. Of course, an annular chamfer 308 may be employed, as depicted in FIG. 5*a*. As depicted in both FIGS. 5 and 5*a*, the superabrasive table 302 and supporting substrate 303 may be configured in a so-called CSE (carbide supported edge) configuration, wherein the superabrasive table 302 and substrate 303 are each configured at the leading end with an angled sidewall for enhanced support of the superabrasive table 302 while still providing a clearance or "relief" angle α of about 10° to 15° to the rear of the cutting edge 309, as depicted in FIG. 5*a* when the cutter 301 is back raked. As may readily be seen from FIG. 5*a*, the angled sidewall 303S of substrate 303 in combination with a relatively high chamfer angle of (for example) 60° and cutter back rake angle of (for example) 25° may be used to provide a relatively very tough cutter configuration which also drills fast and maintains the substrate side wall 303S out of contact with the formation being drilled for a prolonged period of time. Such an arrangement reduces the potential for damaging heat generation resulting from sliding contact of the substrate with the formation immediately behind the superabrasive table 302. CSE cutter configurations are offered by Hughes Christensen Company, an operating unit of the assignee of the present invention, and are more fully described in previously noted U.S. Pat. No. 5,460,233.

Figure 6:
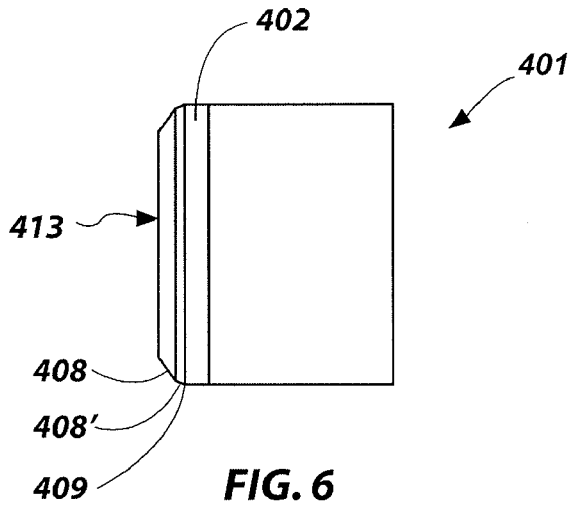
FIG. 6 depicts a side view of yet another embodiment of the cutter of the present invention.

Yet another embodiment of a cutter 401 according to the present invention and exhibiting a larger, inner chamfer 408 on the cutting face 413 of the diamond table 402 angled in accordance with the present invention and bounded at its radially outer periphery by a much smaller, less steeply angled outer chamfer or radiused edge 408', is depicted in FIG. 6. Such an arrangement may be used to provide an aggressive cutter in accordance with the present invention, while the outer chamfer or radiused edge 408' may prevent initial chipping of cutting edge 409 until at least a small wear flat has been established. Edge 408' may, in some embodiments, be characterized as a sharp, "honed" edge with an associated small chamfer or radius only sufficiently large to preclude edge damage during initial engagement of the cutter 401 with the formation as drilling is initiated.

The actual angle of contact of the cutting face of embodiments of cutters of the invention with the formation (and thus the effective back rake) is determined in part by the chamfer angle, and in part by the back rake angle of the cutter itself, as is known in the art. In comparison to conventional superabrasive cutters of similar chamfer depths wherein the chamfer is relatively quickly removed and, subsequently, only the back rake angle of the cutter itself contributes to compression of the superabrasive table, the prolonged chamfer life of cutters according to embodiments of the present invention helps maintain the superabrasive table in compression for an extended period, significantly contributing to cutter integrity over an extended wear life thereof.

Figure 7:
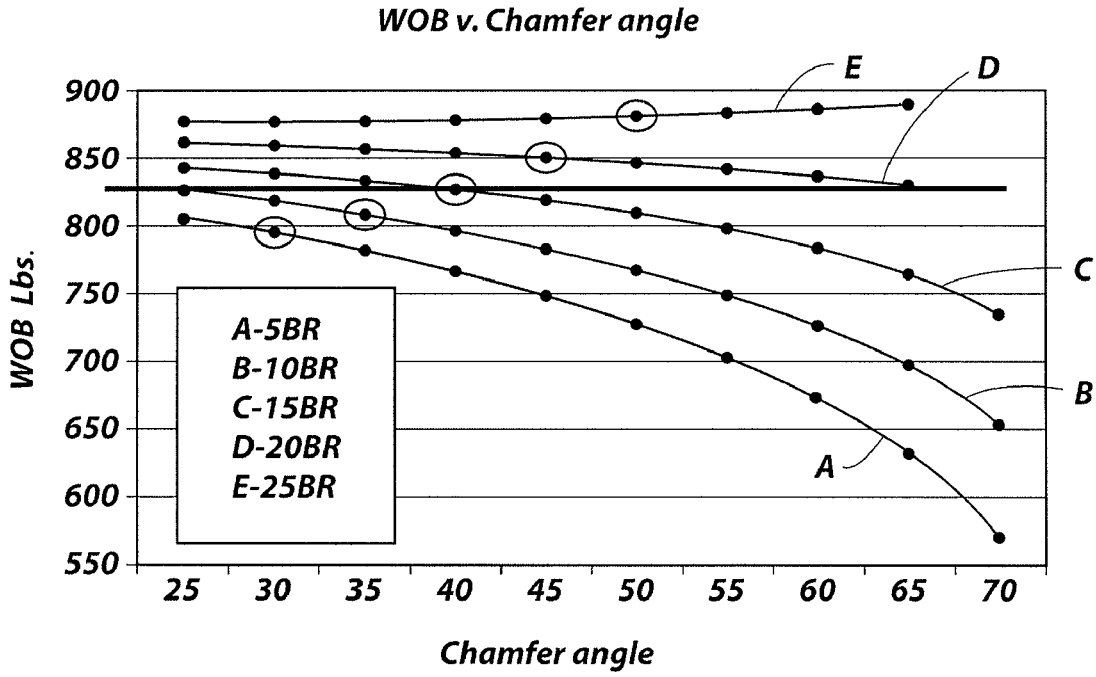
FIG. 7 is a graph of a theoretical relationship between cutter chamfer angle and cutter back rake as affecting required weight on bit to achieve a given depth of cut.

FIG. 7 of the drawings demonstrates a computer analysis of predicted relationship of chamfer angle in combination with cutter back rake angle for various combinations of chamfer angles and cutter back rakes in terms of WOB required for a given DOC. The modeled rock was Sierra White Granite, and drilling was simulated at an ROP of 20 ft/hr, at a rotational speed of 60 RPM, using a chamfer depth of 0.016 inch and a depth of cut DOC of 0.067 inch. As can be seen, for relatively low cutter back rake angles, on the order of 5°, 10°, and 15°, chamfer angles in the 55° to 70° range offer a significant reduction in required WOB for a given DOC. This reduction in required WOB for a desired DOC, while maintaining the superabrasive table cutting face in a compressive stress state as described above, provides enhanced cutting efficiency and may prolong cutter life, although this has not been confirmed.

It should be noted that cutters, according to embodiments of the present invention, are significantly beneficial when used to drill hard formations exhibiting above about 15 Kpsi unconfined compressive strength, and even more so when used in ultrahard formations exhibiting an unconfined compressive strength in excess of about 25 Kpsi. Such cutters are also particularly suitable for use in drilling abrasive formations, where smaller wear flats are desirable to maintain ROP. For example, laboratory tests using cutters according to embodiments of the present invention on Sierra White granite, which exhibits a 26 Kpsi UCS and is very abrasive, produced excellent results.

Figure 8:
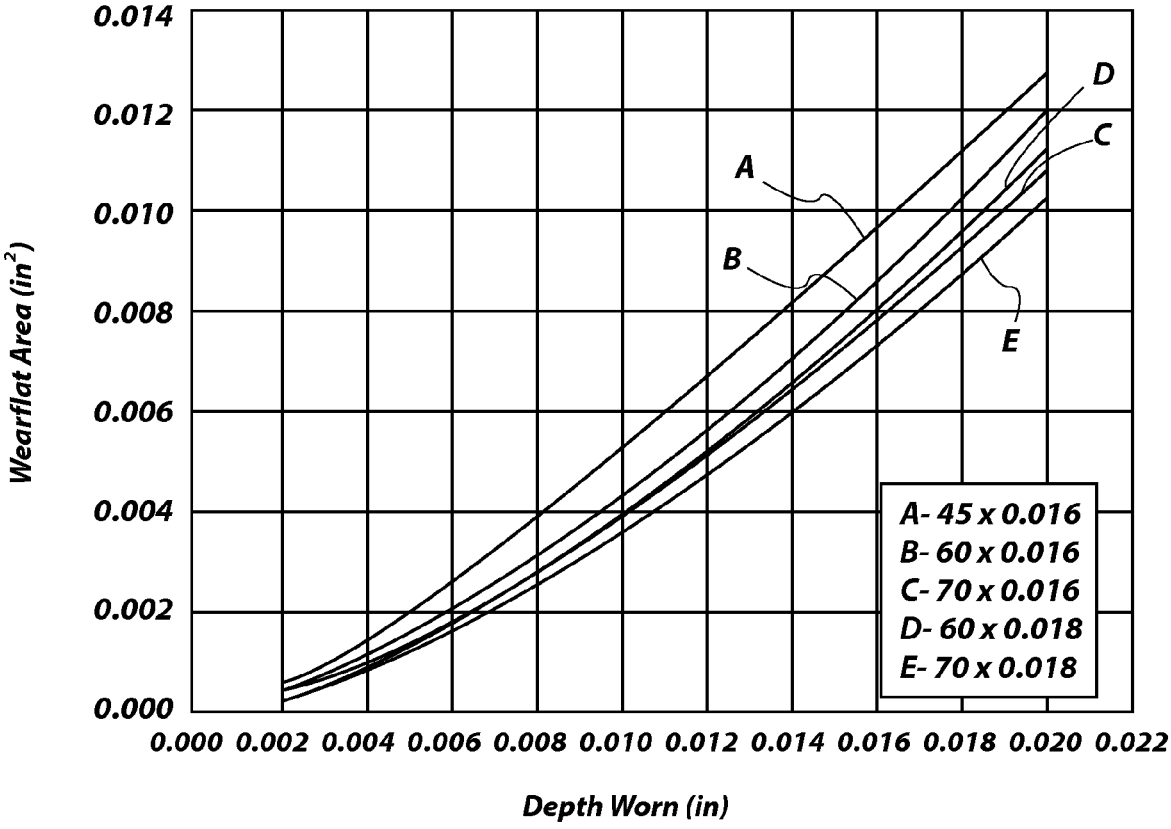
FIG. 8 is a graph of a theoretical wear flat analysis for predicting wear flat surface area as a function of chamfer angle for a given cutter back rake angle.

A graphic illustration of the longevity benefits of configuring a cutter in accordance with embodiments of the present invention is presented in FIG. 8. FIG. 8 graphically depicts results of a theoretical wear flat analysis performed with respect to a 16 mm diameter PDC cutter oriented at a 20° cutter back rake. The graph indicates a significant benefit in terms of reduction of wear flat area of using either a 0.016 inch or 0.018 inch chamfer depth with a chamfer angle of 60° or 70° (curves B through E), in comparison to the same cutter with a 0.016 inch depth 45° chamfer (curve A). In FIG. 8, in the inset to the graph, the first number associated with each curve A, B, etc., designates the chamfer angle, and the second number, the chamfer depth in inches.

Figure 9:
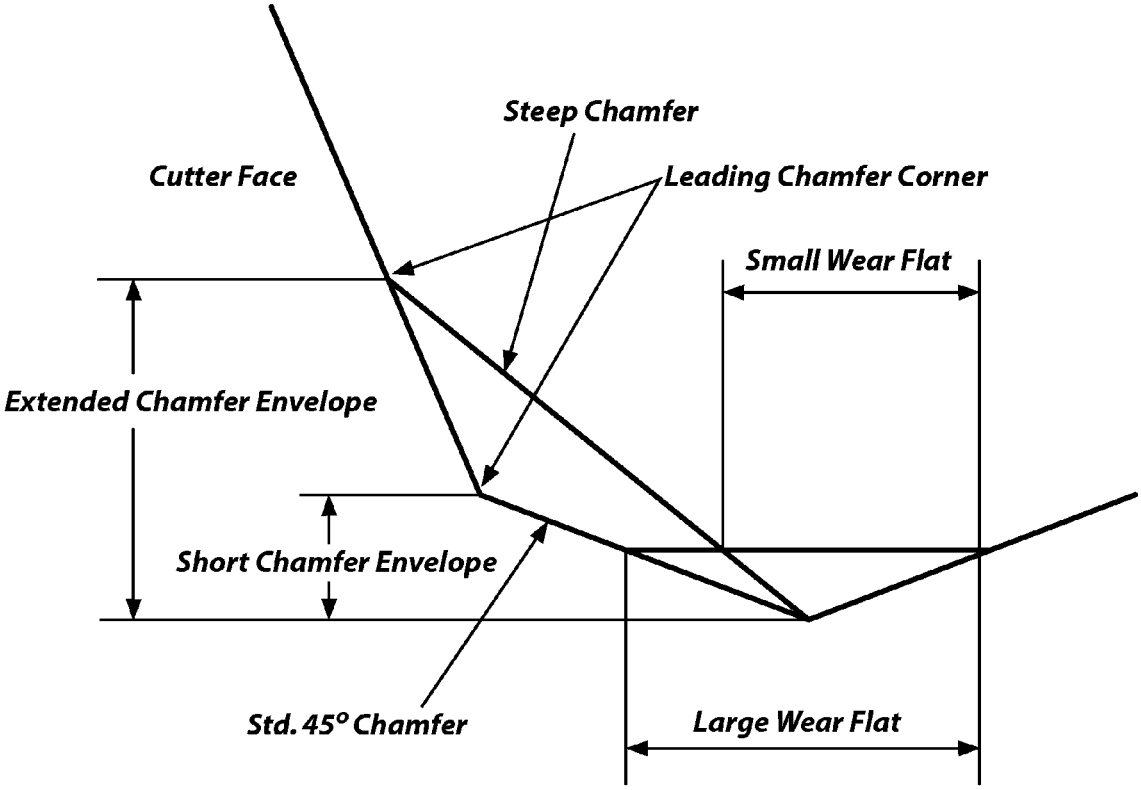
FIG. 9 is schematic depiction of a 45° chamfer angle cutting face of a conventional PDC cutter in comparison to a 60° angle chamfer angle cutting face of a PDC cutting element in accordance with an embodiment of the present invention, showing the effect of the present invention on wear flat generation and an enhanced ability to maintain depth of cut within the chamfer.

FIG. 9 of the drawings is a schematic depiction of an enlarged portion of a PDC cutting element and a portion of the cutting face, showing a conventional 45° chamfer (termed Std. 45° Chamfer) angle with a superimposed 60° chamfer angle (termed a "Steep Chamfer" in the drawing figure) according to an embodiment of the present invention. The PDC cutting element is back raked, as is conventional when cutting a formation, with respect to the horizontal line of cutter travel moving from right to left on the drawing sheet. As can readily be seen, the conventional 45° chamfer, over time, results in the formation of a relatively large (long, front to back) wear flat, denoted as "Large Wear Flat" in the figure, while the steeper chamfer of the present invention results in a substantially smaller (shorter) wear flat, denoted as "Small Wear Flat" in the figure. Further, a comparison of the "short Chamfer envelope" of the conventional 45° chamfer to the "extended Chamfer envelope" of the steeper chamfer according to the present invention makes it clear that the present invention enables beneficially maintaining the depth of cut within the chamfer envelope by enabling a substantially larger depth of cut as well as sustaining greater wear of the PDC table before the chamfer envelope is exceeded. As noted previously, in most instances if the wear flat can be maintained within the chamfer envelope, catastrophic failure of the cutter due to spalling and chipping of the cutting face is avoided. The longer the period of time, in terms of cutter usage during drilling operations that the wear flat is maintained within the chamfer envelope, the longer the leading chamfer edge remains beneficially in compression. Once the wear flat increases and wears into the cutting face inside the inner boundary of the chamfer, increased incidences of spalling of the PDC table result.

Figure 10:
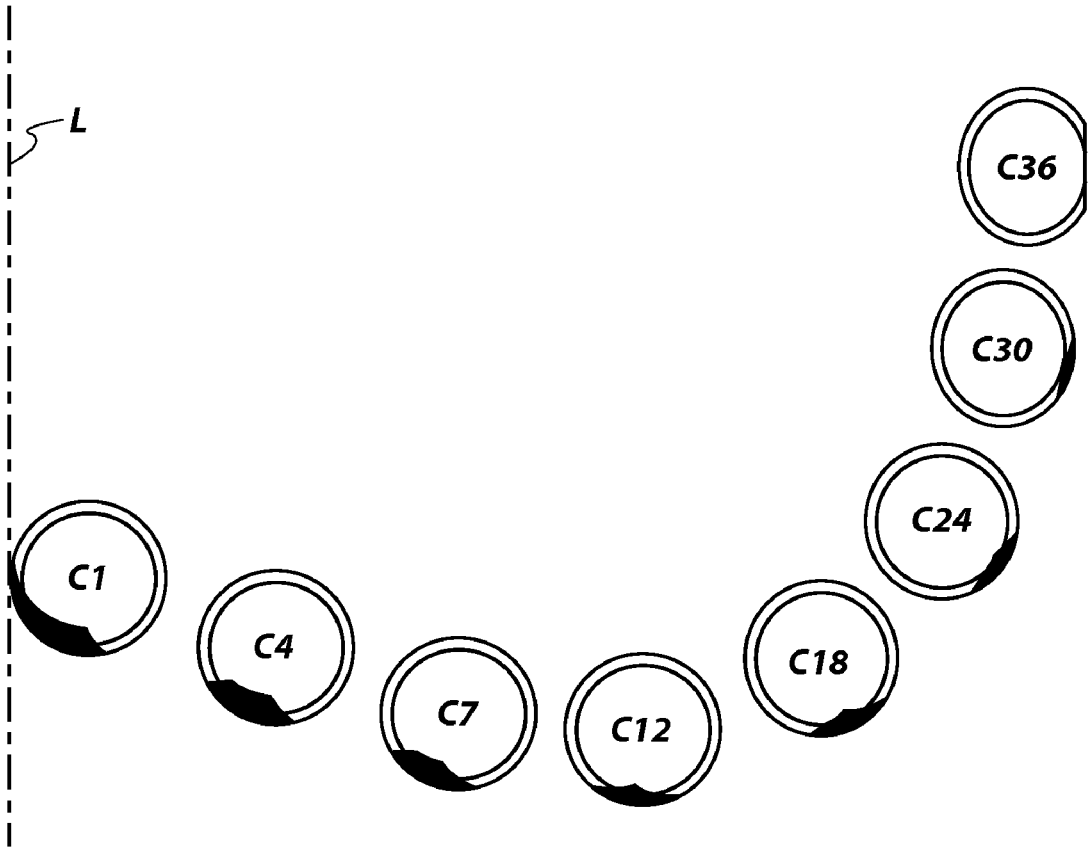
FIG. 10 is a schematic drawing of cutter placement on a single blade of a drag bit, showing in black the relative formation area being cut by each cutter on the blade.

Referring now to FIG. 10 of the drawings, benefits of employing different embodiments of cutters according to the present invention will be described. FIG. 10 is a schematic view of cutter placement along an edge of a single blade of a drag bit. The cutter designated C1 is closest to the longitudinal axis L of the bit, while the cutter designated C36 is farthest from longitudinal axis 1. The cutter numbers between C1 and C36 on FIG. 10 are not sequential, as the missing numbers are attributable to cutters on other blades of the bit. According to industry practice, the "number 1" cutter is the cutter immediately adjacent the bit axis, while succeeding cutter numbers are assigned to cutters at ever-greater radial distances from the axis, regardless of on which blade any particular cutter is located. The inner arcuate line on each cutter is the inner boundary of the chamfer envelope. On each cutter, the black area depicts a scalloped area of cut, the irregular area of cut shape being attributable to a path previously cut through the formation by another, radially adjacent cutter on another blade. It can also be seen that the area of cut on, for example, the number C1 and C4 cutters on the cone region of the bit is substantially greater than, for example, the area of cut on number C18 and C24 cutters on the bit shoulder. As can be readily seen, for cutters number C24 and C18 the area of cut is largely contained within the chamfer envelope.

Thus, drilling performance for cutters number C24 and C18 is very dependent on chamfer angle for drilling performance in terms of cutting efficiency and durability. Conventionally, such cutters may have relatively high back rakes (note the somewhat elliptical shapes of cutter numbers C30, C36, reflecting high back rakes), resulting in a tough cutter in terms of durability but compromising drilling efficiency when a conventional 45° chamfer is employed. By using a cutter according to an embodiment of the invention using a relatively steep chamfer angle and maintaining the area of cut within the chamfer envelope, drilling efficiency is enhanced, less frictional heat is generated and prolonged cutter life results.

It has been observed by the inventors that, while cutters according to embodiments of the invention drill faster than conventionally chamfered cutters, in some instances use of such cutters on a drill bit may result in higher torque rates and increased vibration. In such instances, it may be desirable to employ so-called depth of cut control technology as is offered by Hughes Christensen Company as "EZ Steer" technology, as described in U.S. Pat. No. 6,298,930 and No. 6,460,631, each assigned to the assignee of the present invention and the disclosure of each of which is incorporated herein in its entirety by reference. Such technology may be used to prevent over-torquing of the bit or the bit drilling too fast, and provides greater cutter durability. Other approaches include the use of additional cutters, and to employ such cutters on so-called "heavy set" bits with a large number of cutters and enhanced cutter redundancy.

While the present invention has been described and illustrated in conjunction with a number of specific embodiments, those skilled in the art will appreciate that variations and modifications may be made without departing from the principles of the invention as herein illustrated, described and claimed. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A rotary drilling apparatus for drilling subterranean formations, the apparatus comprising:

a body having a leading surface comprising at least a cone region;

a plurality of cutting elements mounted to the leading surface, wherein at least one cutting element of the plurality located in the cone region is oriented at a back rake of 15° or less and comprises:

a superabrasive table extending transverse to a longitudinal axis of the cutting element, and including:

a cutting face having periphery including a chamfer along at least a portion thereof extending to proximate a cutting edge;

wherein the chamfer is oriented at an angle, relative to the longitudinal axis of the cutting element, of 55° or greater; and wherein the chamfer has a depth, measured parallel to the longitudinal axis from an inner boundary of the chamfer to the cutting edge, of no greater than about 0.025 inch.

2. The apparatus of claim 1, wherein the at least one cutting element further comprises a supporting substrate to which the superabrasive table is bonded.

3. The apparatus of claim 1, wherein the chamfer is oriented at an angle of no greater than about 85° to the longitudinal axis of the cutting element.

4. The apparatus of claim 1, wherein the chamfer is oriented at an angle of between about 55° and about 70° to the longitudinal axis of the cutting element.

5. The apparatus of claim 1, wherein the depth of the chamfer is no less than about 0.002 inch.

6. The apparatus of claim 1, wherein the cutting face within the inner boundary of the chamfer is substantially planar.

7. The apparatus of claim 1, wherein the superabrasive table comprises a polycrystalline diamond compact.

8. The apparatus of claim 1, wherein the at least one cutting element further comprises a supporting substrate to which the superabrasive table is bonded, the superabrasive table is substantially circular and the supporting substrate is substantially cylindrical and formed of a metal material.

9. The apparatus of claim 1, further comprising another chamfer outward of the chamfer, at a lesser angle relative to the longitudinal axis and of a lesser depth, and closer to the cutting edge than the chamfer.

10. The apparatus of claim 1, further comprising a radiused edge outward of the chamfer closer to the cutting edge than the chamfer.

11. The apparatus of claim 1, wherein the at least one cutting element further comprises a supporting substrate of a metal material to which the superabrasive table is bonded, wherein at least a portion of a sidewall of the superabrasive table adjacent the cutting edge and an adjacent portion of the sidewall of the supporting substrate each lie at an acute angle to the longitudinal axis.

12. A rotary drilling apparatus for drilling subterranean formations, the apparatus comprising:

a body having a leading surface;

a plurality of cutting elements mounted to the leading surface, wherein at least one cutting element of the plurality is oriented at a back rake of 15° or less, and comprises:

a superabrasive table extending transverse to a longitudinal axis of the cutting element, and including:

a cutting face having periphery including a chamfer along at least a portion thereof extending to proximate a cutting edge;

wherein the chamfer is oriented at an angle, relative to the longitudinal axis of the cutting element, of 55° or greater; and wherein the chamfer has a depth, measured parallel to the longitudinal axis from an inner boundary of the chamfer to the cutting edge, of no greater than about 0.025 inch.

13. The apparatus of claim 12, wherein the at least one cutting element further comprises a supporting substrate to which the superabrasive table is bonded.

14. The apparatus of claim 12, wherein the chamfer is oriented at an angle of no greater than about 85° to the longitudinal axis of the cutting element.

15. The apparatus of claim 12, wherein the chamfer is oriented at an angle of between about 55° and about 70° to the longitudinal axis of the cutting element.

16. The apparatus of claim 12, wherein the depth of the chamfer is no less than about 0.002 inch.

17. The apparatus of claim 12, wherein the cutting face within the inner boundary of the chamfer is substantially planar.

18. The apparatus of claim 12, wherein the superabrasive table comprises a polycrystalline diamond compact.

19. The apparatus of claim 12, wherein the at least one cutting element further comprises a supporting substrate to which the superabrasive table is bonded, the superabrasive table is substantially circular and the supporting substrate is substantially cylindrical and formed of a metal material.

20. The apparatus of claim 12, wherein the at least one cutting element further comprises a second chamfer outward of the first chamfer, at a lesser angle relative to the longitudinal axis and of a lesser depth.

21. The apparatus of claim 12, wherein the body comprises a rotary drag bit body, and the leading surface comprises a face on the body.

22. The apparatus of claim 21, further comprising blades extending from the face, and wherein at least some cutting elements of the plurality are disposed on the blades.

23. The apparatus of claim 12, wherein the leading surface comprises a leading surface on at least one blade secured to the body.

24. The apparatus of claim 12, further comprising a radiused edge outward of the chamfer closer to the cutting edge than the chamfer.

25. The apparatus of claim 12, wherein the at least one cutting element further comprises a supporting substrate of a metal material to which the superabrasive table is bonded, wherein at least a portion of a sidewall of the superabrasive table adjacent the cutting edge and an adjacent portion of the sidewall of the supporting substrate each lie at an acute angle to the longitudinal axis.

* * * * *

UNITED STATES PATENT AND TRADEMARK OFFICE

CERTIFICATE OF CORRECTION

PATENT NO. : 7,814,998 B2
APPLICATION NO. : 11/958082
DATED : October 19, 2010
INVENTOR(S) : Suresh G. Patel et al.

It is certified that error appears in the above-identified patent and that said Letters Patent is hereby corrected as shown below:

In the specification:

COLUMN 12, LINE 9, change “side wall” to --sidewall--

Signed and Sealed this
Thirtieth Day of July, 2013

Teresa Stanek Rea
*Acting Director of the United States Patent and Trademark Office*